US005806701A

United States Patent [19]

Bae

[11] Patent Number: 5,806,701

[45] Date of Patent: Sep. 15, 1998

[54] CONTAINER WITH ANTICONTACT CUTOUT AT EACH CORNER

[75] Inventor: In-Kyu Bae, Ulsan-shi, Rep. of Korea

[73] Assignee: Hyundai Precision & Ind. Co., Ltd., Seoul, Rep. of Korea

[21] Appl. No.: 897,386

[22] Filed: Jul. 21, 1997

[30] Foreign Application Priority Data

Mar. 6, 1997 [KR] Rep. of Korea ..... 97-7513

[51] Int. Cl.[6] ..... B65D 21/032

[52] U.S. Cl. ..... 220/1.5; 220/751; 220/608; 220/DIG. 21; 206/512; 206/509

[58] Field of Search ..... 206/503, 504, 206/509, 512; 220/1.5, 646, 608, 669, 751, DIG. 21

[56] References Cited

U.S. PATENT DOCUMENTS

| | | | |
|---|---|---|---|
| 3,591,033 | 7/1971 | Partridge | 220/1.5 |
| 5,141,122 | 8/1992 | Grogan | 220/1.5 |
| 5,160,224 | 11/1992 | Schwiebert . | |
| 5,265,748 | 11/1993 | Furukawa | 220/1.5 |
| 5,267,819 | 12/1993 | Lycett . | |
| 5,415,293 | 5/1995 | Ackermann et al. | 206/509 |
| 5,449,082 | 9/1995 | Reynard | 220/1.5 |
| 5,454,597 | 10/1995 | Thomas et al. . | |
| 5,570,981 | 11/1996 | Brewster . | |
| 5,678,715 | 10/1997 | Sjostedt et al. | 220/1.5 |

*Primary Examiner*—Stephen J. Castellano
*Attorney, Agent, or Firm*—Dilworth & Barrese

[57] ABSTRACT

A container having an anticontact cutout-structure around each corner is disclosed. The cutout-structure almost completely prevents a twist lock from unexpectedly coming into contact with the edge frames of each corner and allows the edge frames to be free from being crushed or broken by the twist lock. In order to form the anticontact cutout-structure, a top cutout is formed on each of the top edge frames at a position around each of the top corner castings, while a bottom cutout is formed on each of the bottom edge frames at a position around each of the bottom corner castings. Each of the top and bottom cutouts has a length and depth suitable for preventing each of the top and bottom edge frames from coming into contact with the twist lock. A metal panel is attached to the surface of each of the top and bottom cutouts, thus protecting each cutout from the twist lock.

9 Claims, 8 Drawing Sheets

CONTAINER WITH ANTICONTACT CUTOUT AT EACH CORNER

BACKGROUND OF THE INVENTION

1. Field of the Invention

The present invention relates, in general, to containers used for transporting goods and, more particularly, to a container with an anticontact cutout, the cutout being provided on the edge frames a round each corner casting of the container and preventing a twist lock from unexpectedly making contact with the edge frames thus allowing the edge frames to be free from being crushed or broken by the twist lock when the twist lock engages with the corner casting.

2. Description of the Prior Art

As well known to those skilled in the art, a container is a large-sized metal or aluminum box used for safely transporting goods while protecting the contents (goods) from external impact. Such containers are international standard-sized so that it is possible to stably hold a container on a container lorry or a container train and to stably stack a plurality of containers on a container ship with one container being laid on top of another regardless of the manufacturers of the containers.

A typical international standard-sized container is shown in FIG. 1. As shown in the drawing, a corner casting 101 is provided on each of the eight corners of the container.

FIG. 2 shows the construction of such a corner casting 101 in detail. As shown in the drawing, the casting 101 is mounted to each corner of the container, at which three plates meet together. A lock opening 103 is formed on the top surface of the casting 101 and securely engages with a twist lock 102 of a container moving means, for example, a container crane, when the container is loaded onto a container lorry or a container train or is laid on top of another container.

In order to lift, move and stack such a container, the container is preferably handled by a crane 104 with four twist locks 102 securely engaging with the lock openings 103 of four corner castings 101 as shown in FIG. 3.

However, the typical container is problematic in that when the twist locks 102 engage with the openings 103 of the castings 101 prior to moving the container, each twist lock 102 may be brought into contact with an edge frame 105, 106, 107, 108 around an associated casting 101 thus crushing or breaking the edge frame.

While the twist locks 102 approach the openings 103 of the castings 101 in order to engage with the openings 103, each lock 102 has to precisely move in a desirable direction indicated by arrow A of FIG. 2. However, the lock 102 may unexpectedly move in an undesirable direction indicated by arrow B or B' due to an operational error of the crane, thus diverging from the opening 103. The lock 102 diverging from the opening 103 is brought into contact with an edge frame 105, 106 around the casting 103, thereby crushing or breaking the edge frame.

FIG. 4 shows a plurality of containers stacked on a support surface with one container being laid on top of another. In order to stack the containers as shown in FIG. 4, an upper container C1 has to be laid on top of a lower container C2, with a fixing twist lock 9 being mounted to each of the top corner castings 101 of the lower container C2 and engaging with the opening 103 of each of the bottom corner castings 101 of the upper container C1.

However, the container C1 may unexpectedly come down onto the lower container C2 in an undesirable direction indicated by arrow C or C' as shown in FIG. 5 due to an operational error of a crane. In this case, the fixing twist lock 9 may come into contact with an edge frame 107, 108 around an associated bottom casting 101 of the upper container C1, thus crushing or breaking the edge frame 107, 108.

SUMMARY OF THE INVENTION

Accordingly, the present invention has been made keeping in mind the above problems occurring in the prior art. An object of the present invention is to provide a container, which is provided with an anticontact cutout-structure at the edge frames around each corner of the container thus almost completely preventing a twist lock from unexpectedly coming into contact with the edge frames and allowing the edge frames to be free from being crushed or broken by the twist lock when the twist lock engages with an associated corner casting of the container.

In order to accomplish the above object, a container in accordance with the invention comprises a plurality of top and bottom edge frames forming a plurality of top and bottom corners, a top or bottom corner casting provided on each of the corners, and a lock opening formed on each of the top and bottom corner castings and adapted for engaging with a twist lock, further comprises: a top cutout formed on each of the top edge frames at a position around each of the top corner castings, the top cutout having a length and depth suitable for preventing each of the top edge frames from coming into contact with the twist lock. The container also has a bottom cutout formed on each of the bottom edge frames at a position around each of the bottom corner castings, the bottom cutout having a length and depth suitable for preventing each of the bottom edge frames from coming into contact with a fixing twist lock.

A metal panel is attached to the surface of the top cutout, thus protecting the top cutout from the twist lock.

BRIEF DESCRIPTION OF THE ACCOMPANYING DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 6:
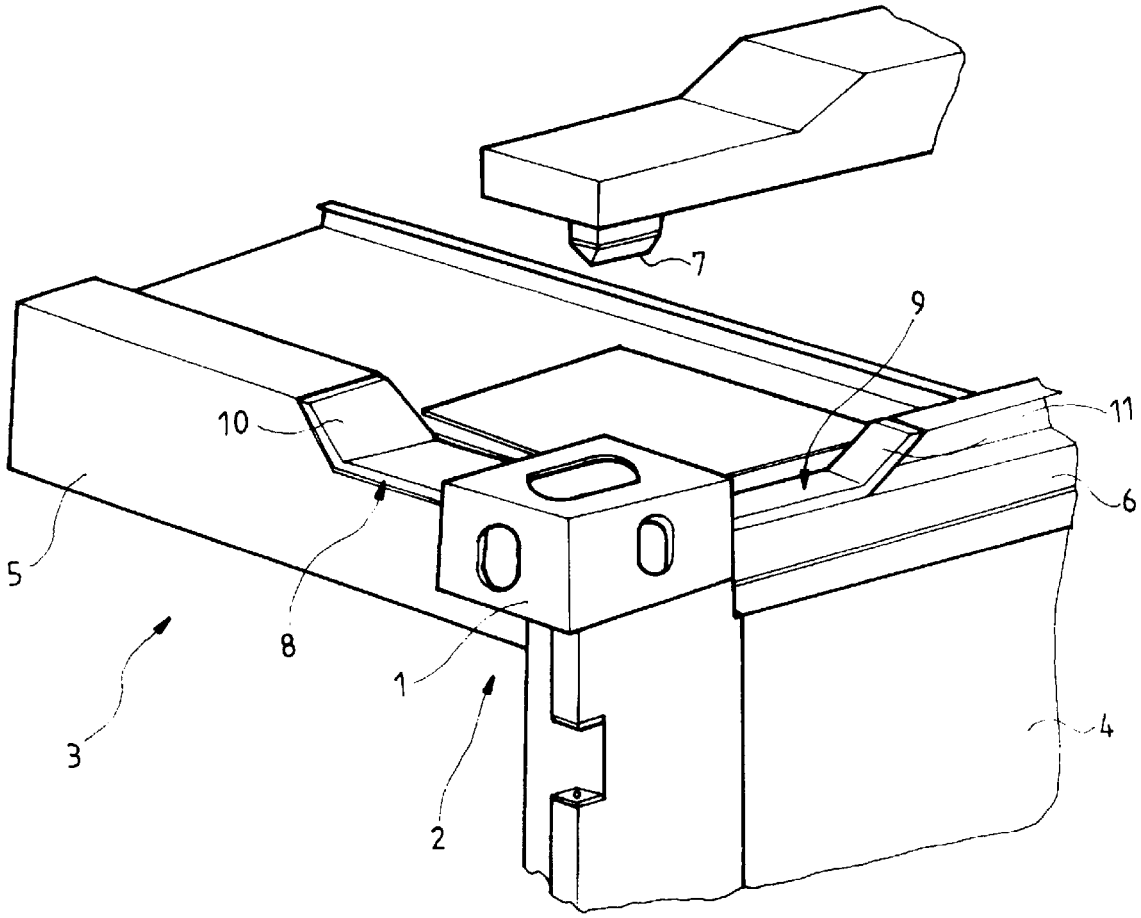
FIG. 6 is a perspective view showing the operational effect of an anticontact cutout provided on each of the top corners of a container in accordance with the primary embodiment of the present invention.

In the same manner as that described for the prior art, the container of this invention is international standard-sized and has a corner casting at each of the eight corners. FIG. 6 shows an anticontact cutout provided on each of the top corners 2 of a container in accordance with the primary embodiment of this invention. As shown in the drawing, the top corner 2 is formed by two top edge frames 5 and 6, which are mounted to the top edges of the front and side plates 3 and 4 of the container respectively.

A corner casting 1, which is provided on each top corner 2 of the container, securely engages with a twist lock 7 of a container moving means, for example, a container crane, thus allowing the crane to safely lift and move the container to a desirable position when it is necessary to load the container onto a container lorry or a container train or lay the container on top of another container on a support surface.

The anticontact cutout of this invention is for preventing a twist lock from unexpectedly coming into contact with the edge frames of a corner casting, thus protecting the edge frames from the twist lock when the twist lock engages with the corner casting. In the primary embodiment, the anticontact cutout comprises a top cutout, which is formed on each of the top edge frames 5 and 6 and allows the twist lock 7 to pass over the edge frames 5 and 6 without crushing or breaking the frames 5 and 6 when the lock 7 engages with the casting 1.

That is, a top cutout 8, 9 is formed on the top surface of each top edge frame 5, 6 at a position approximate to the corner casting 1. In order to form the cutout 8, 9, each of the frames 5 and 6 is cut thoroughly in a transverse direction, partially in a longitudinal direction and partially in a vertical direction.

The cutout 8, 9 may be vertically flat at a side wall approximate to the casting 1 and inclined at the other side wall remote from the casting 1, and horizontally flat at an intermediate bottom wall as shown in FIG. 6.

Figure 8:
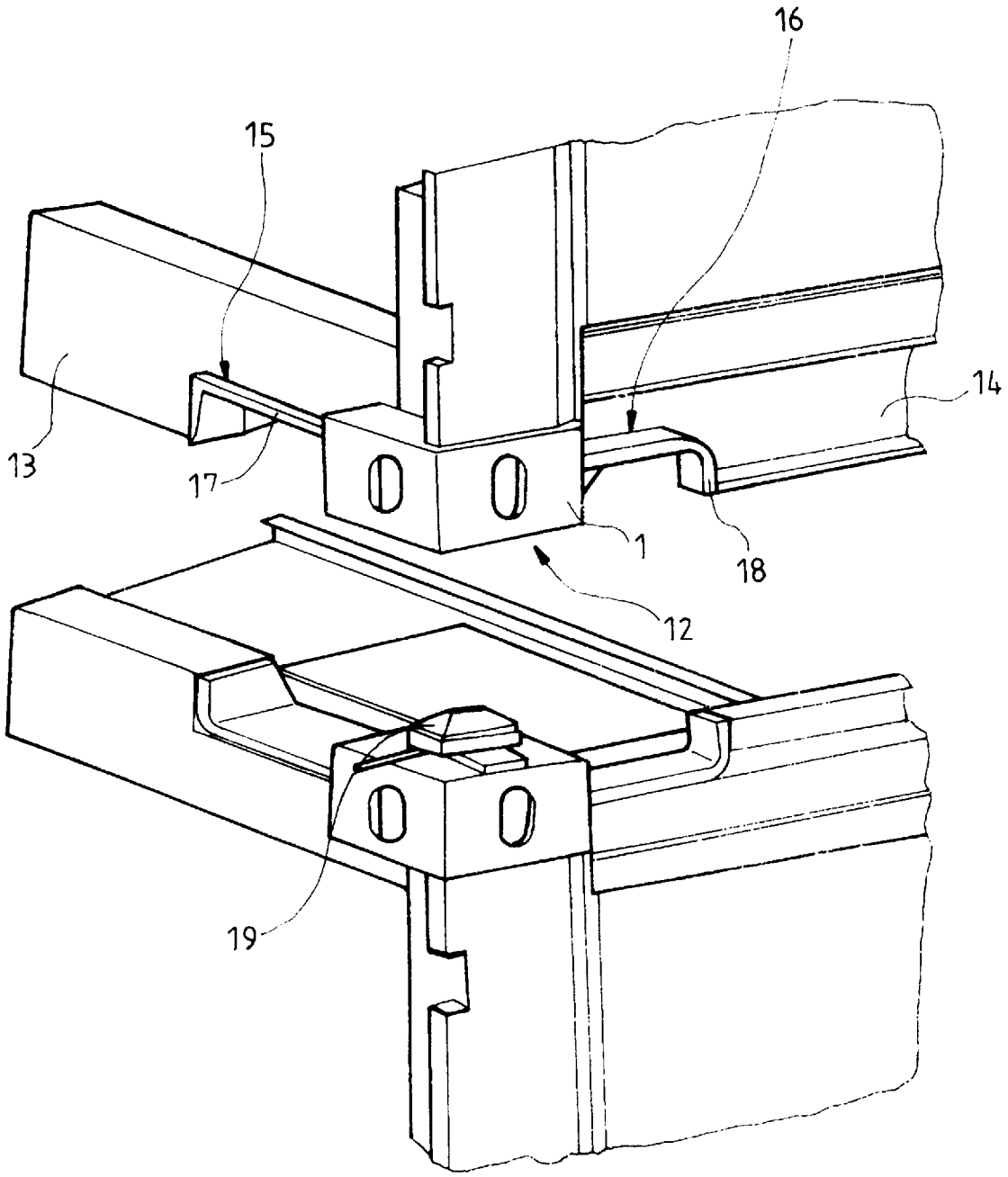
FIG. 8 is a perspective view showing an anticontact cutout provided on each of the bottom corners of a container in accordance with another embodiment of the present invention.

Alternatively, the cutout may be vertically flat at opposite side walls approximate to and remote from the corner casting and horizontally flat at an intermediate bottom wall as shown in FIG. 8.

It is preferable to attach a metal panel 10, 11 to each of the cutouts 8 and 9, thus protecting the surface of the cutout 8, 9. Due to the metal panels 10 and 11 the edge frames 5 and 6 are effectively protected even when the twist lock 7 comes into unexpected contact with the frames 5 and 6.

As described above, a cutout 8, 9 is formed on each of the top edge frames 5 and 6 around a corner casting 1 of the container, thus reducing the thickness of each frame 5, 6 at a position approximate to the casting 1. Due to the cutout 8, 9, the twist lock 7 passes over the edge frames 5 and 6 without crushing or damaging the frames 5 and 6 even when the lock 7 is unexpectedly lowered in an undesirable direction indicated by arrow B or B' due to an operational error of a crane. Therefore, the cutouts 8 and 9 effectively protect the edge frames 5 and 6 from the twist lock 7. If each of the cutouts 8 and 9 has a metal panel 10, 11, each of the edge frames 5 and 6 is effectively protected from the twist lock 7 even when the lock 7 comes into unexpected contact with the frame 5, 6 at the cutout 8, 9.

Figure 7:
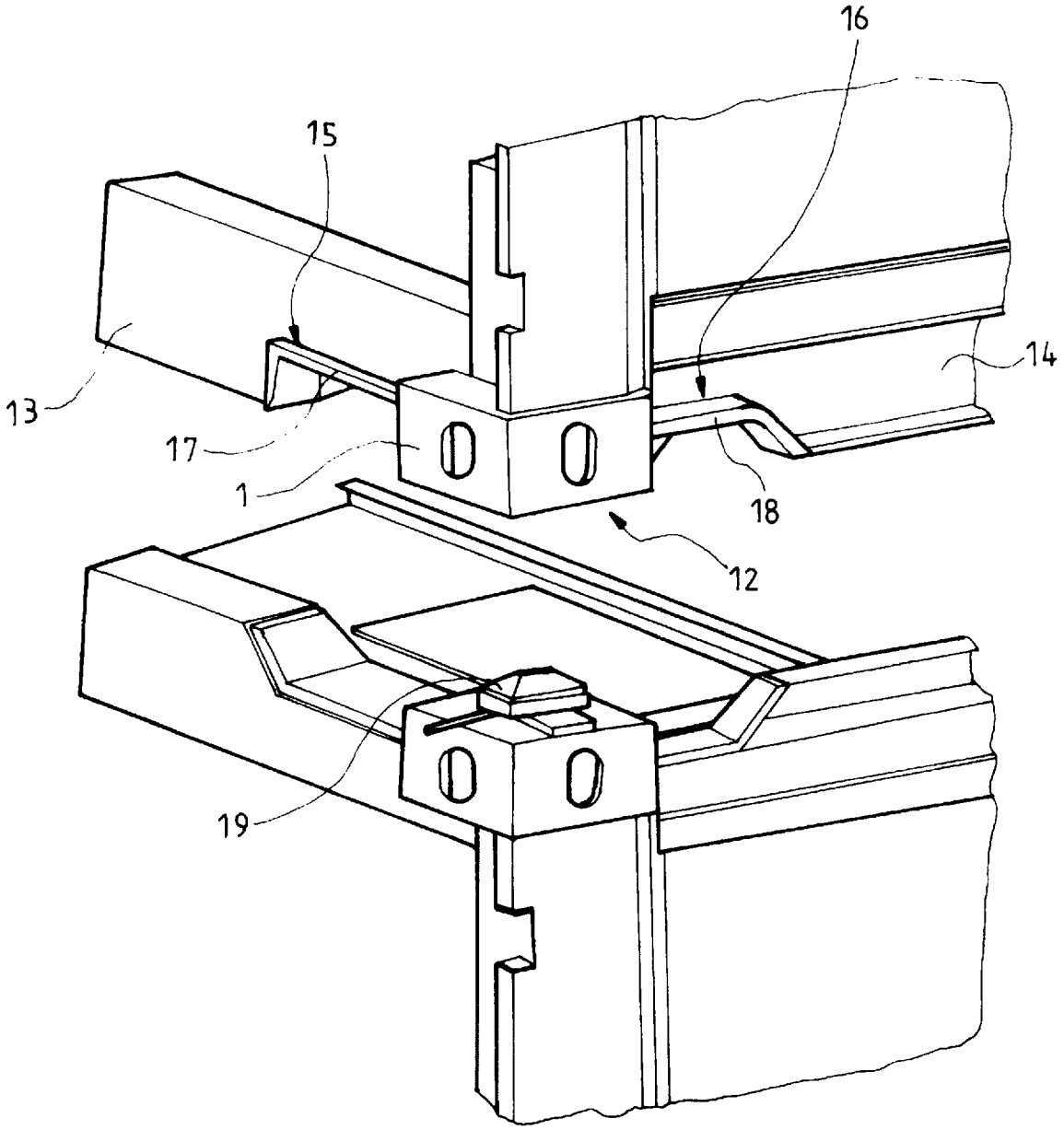
FIG. 7 is a perspective view showing the operational effect of an anticontact cutout provided on each of the bottom corners of the container of this invention when the container is laid on top of another container.

Such a cutout may be provided on each of the bottom corners of a container as shown in FIGS. 7 and 8.

As shown in FIG. 7, each of the bottom corners 12 of the container is formed by two bottom edge frames 13 and 14 and has a corner casting 1.

In the same manner as described for the top edge frames 5 and 6, a bottom cutout 15, 16 is formed on each of the bottom edge frames 13 and 14 at a position approximate to the corner casting 1.

The configuration of each bottom cutout 15, 16 remains the same as that described for the top cutout 8, 9 of the top frame 5, 6 and further explanation thereof is thus not deemed necessary. Of course, the side wall of each bottom cutout 15, 16 formed at a position remote from the casting may be vertically flat or inclined at an angle of inclination. In addition, each of the cutouts 15 and 16 may be provided with a metal panel 17, 18 suitable for protecting the surface of the cutout 15, 16 from a twist lock.

Figure 1:
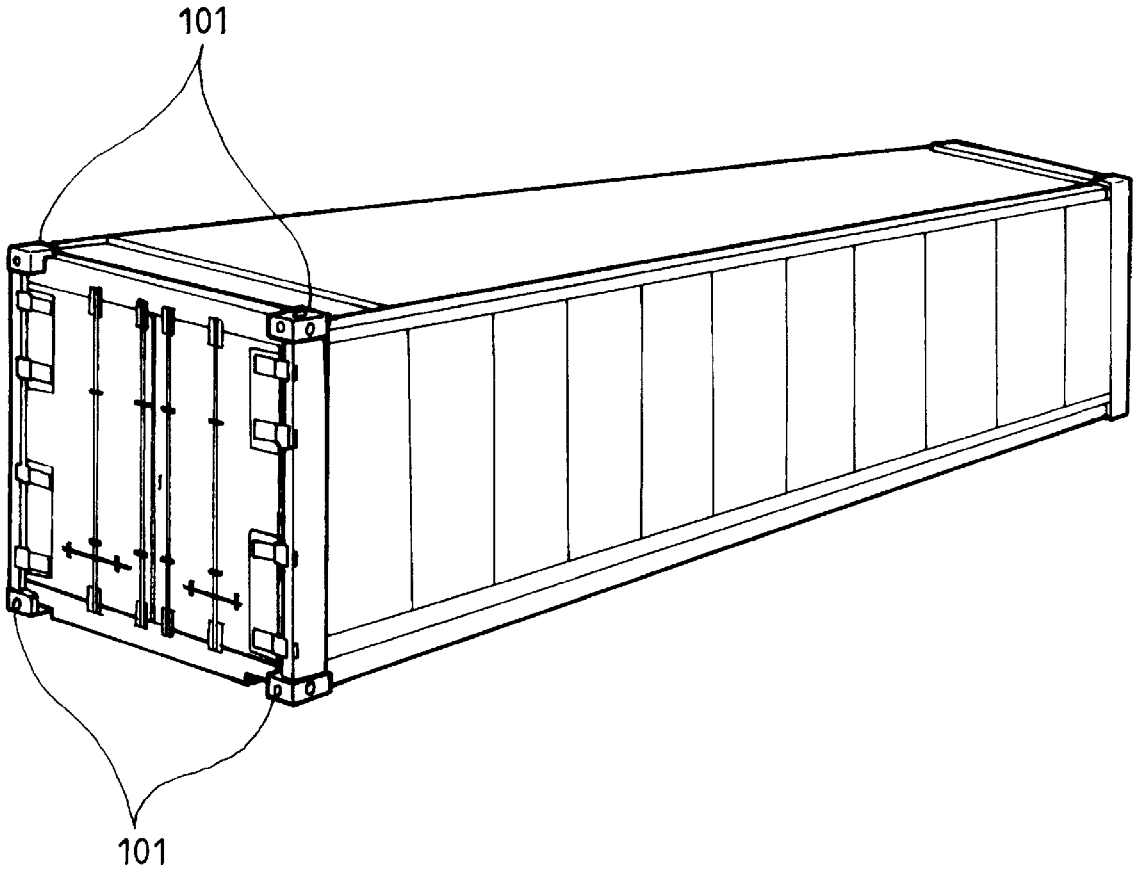
FIG. 1 is a perspective view of a typical international standard-sized container used for transporting goods.
Figure 2:
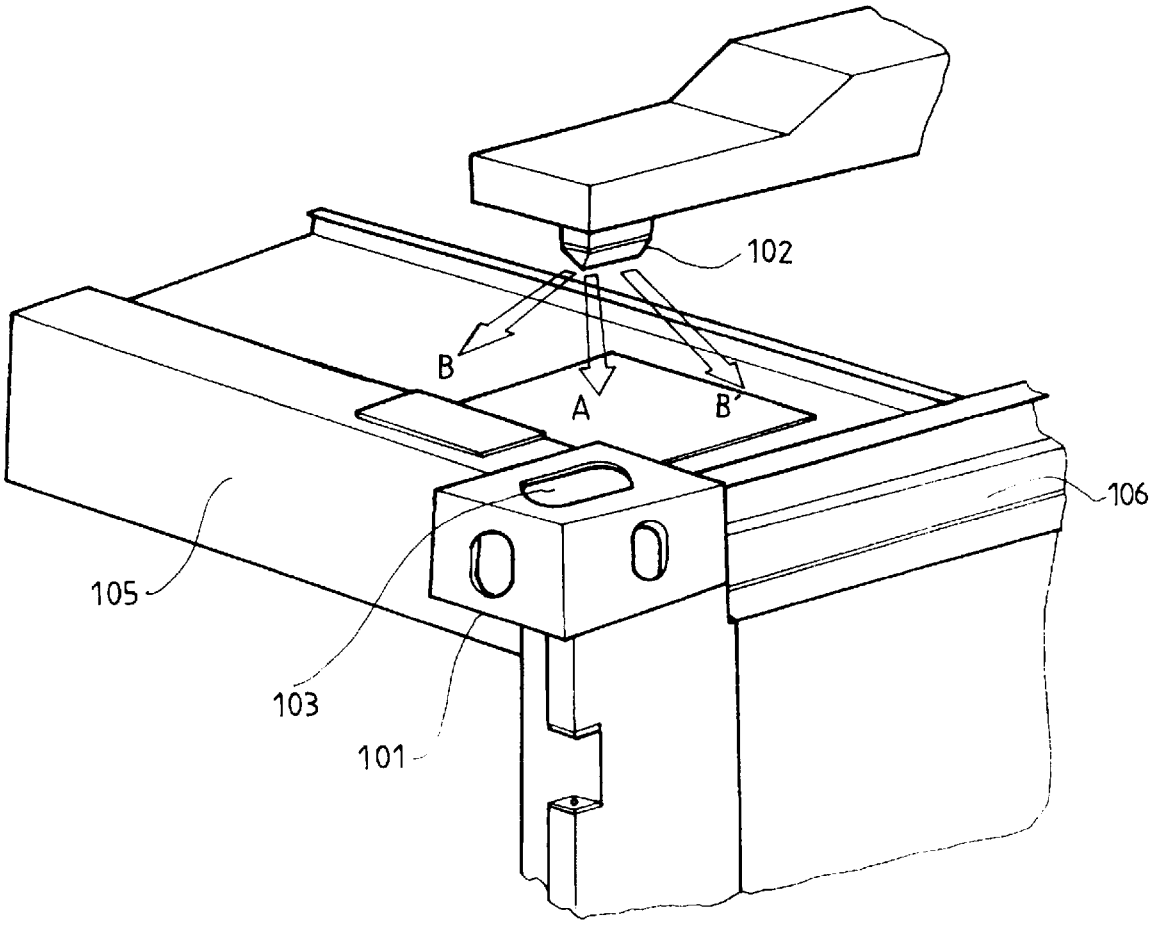
FIG. 2 is a perspective view showing how the edge frames around a top corner casting of the typical container are crushed or broken by a twist lock when the twist lock reaches the top corner casting.
Figure 3:
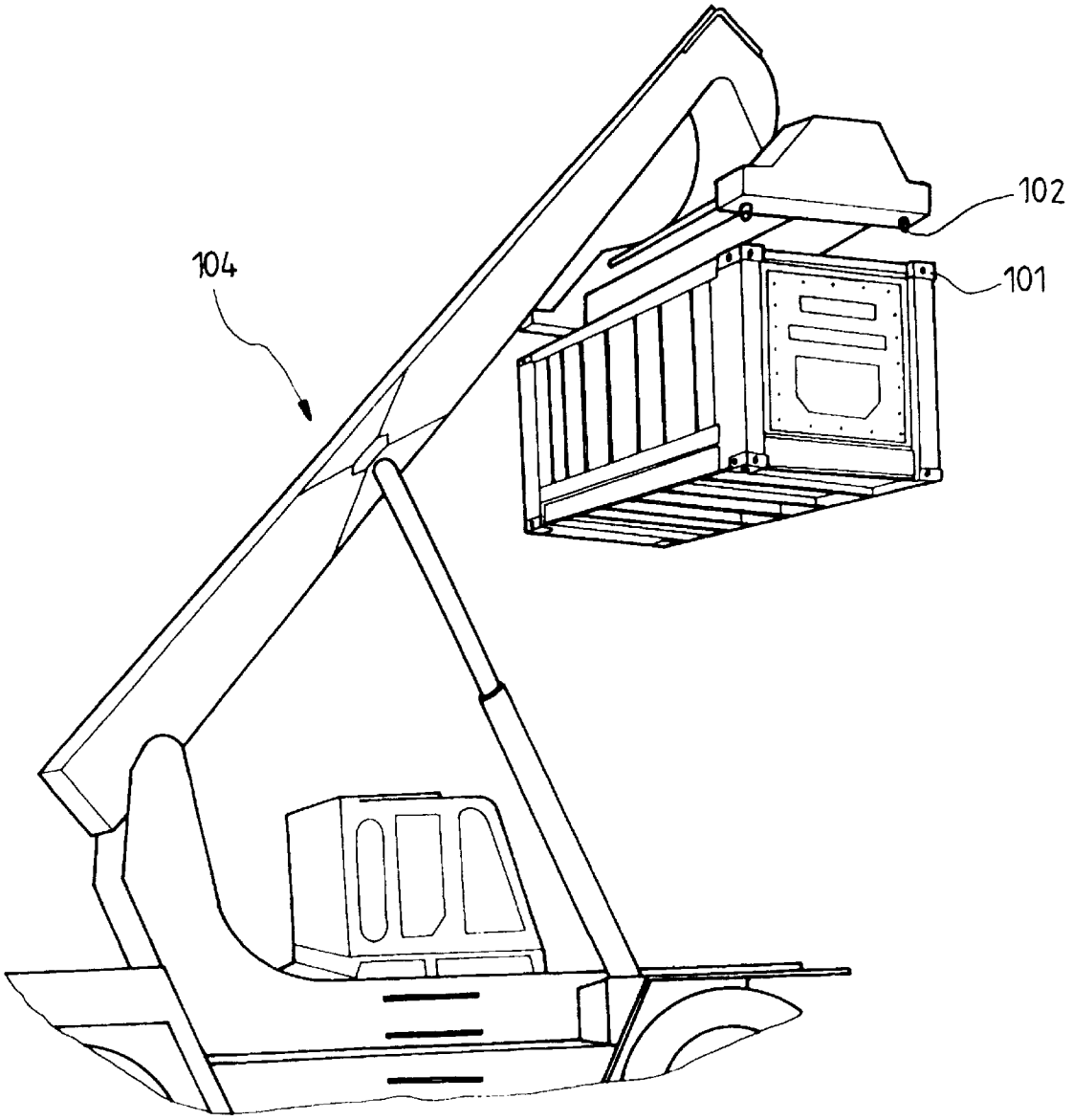
FIG. 3 is a perspective view of the typical container lifted and moved by a crane.
Figure 4:
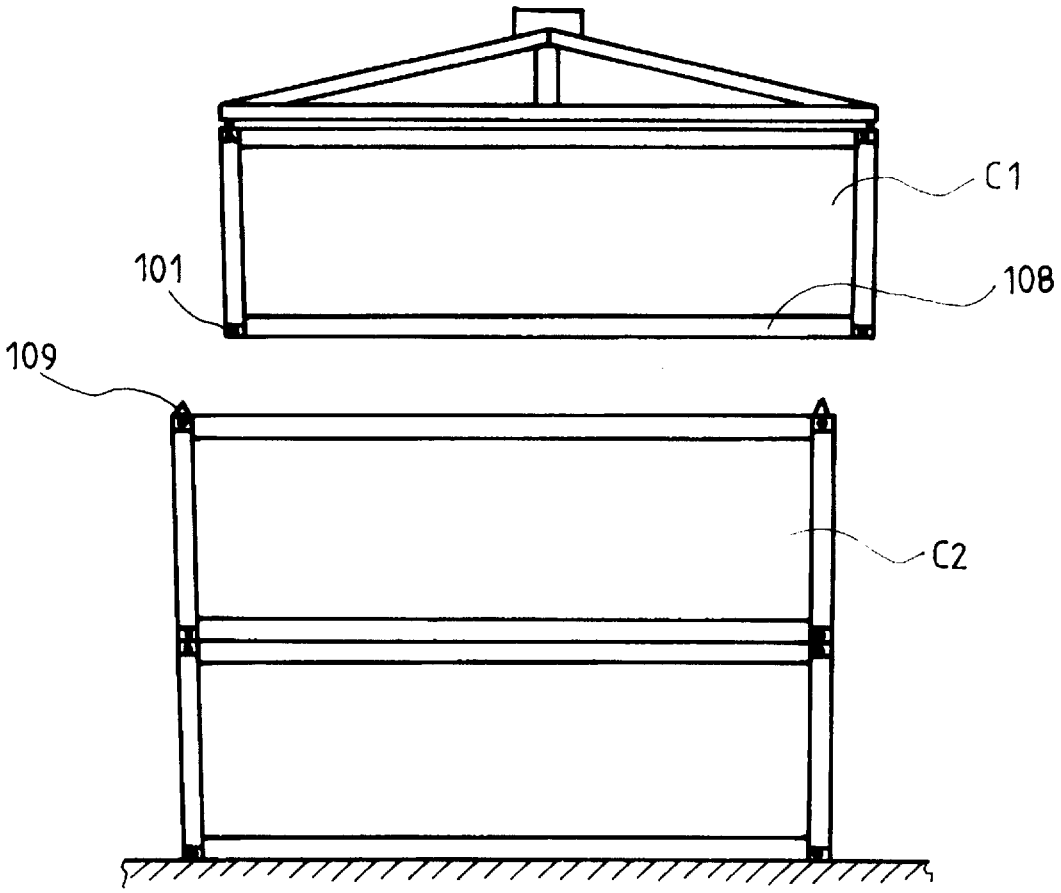
FIG. 4 is a view showing a plurality of typical containers stacked on a support surface with one container being laid on top of another.
Figure 5:
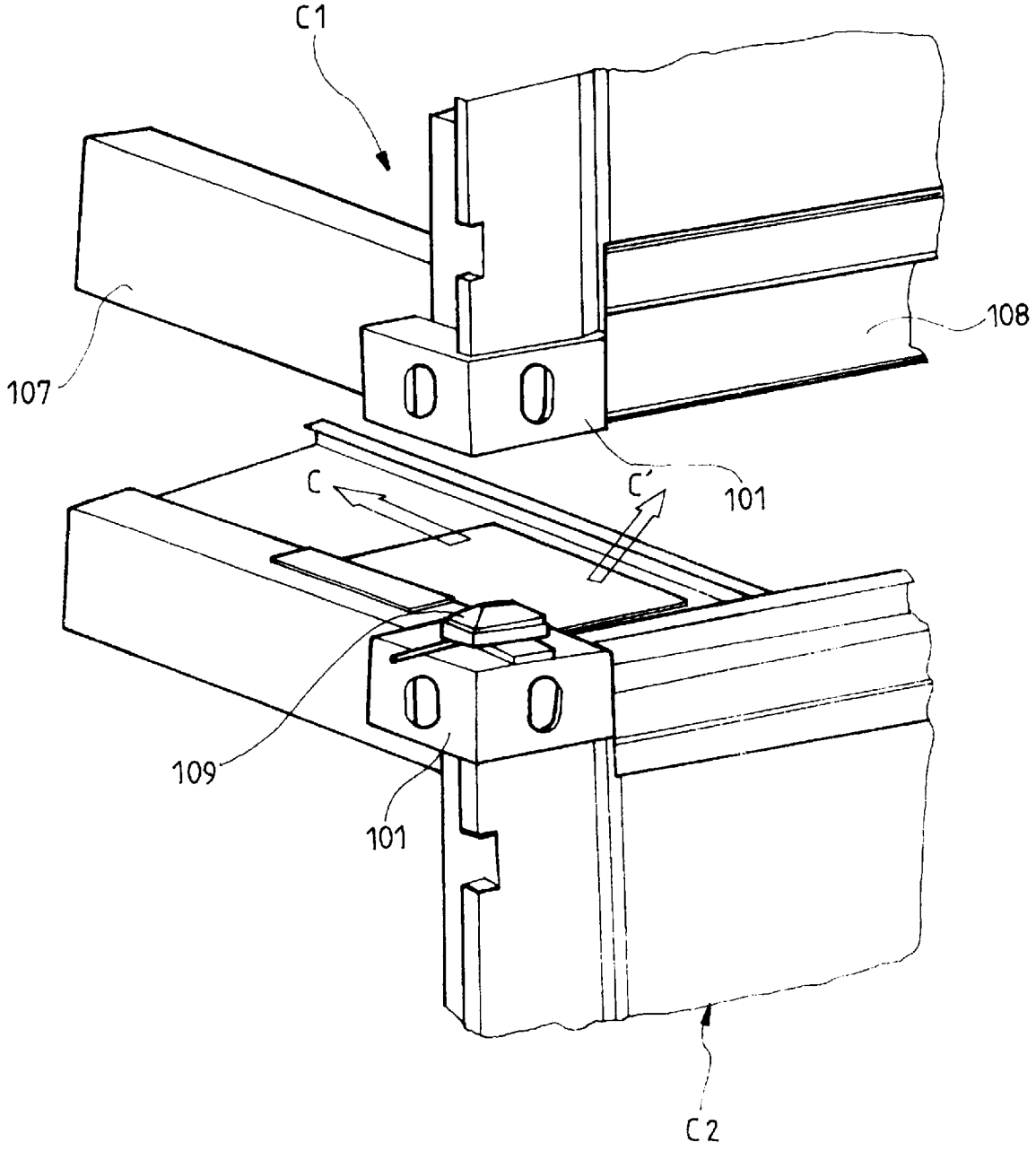
FIG. 5 is a perspective view showing how the edge frames around a bottom corner casting of a typical container are crushed or broken by a fixing twist lock of another container when the containers are stacked on a support surface with one container being laid on top of another.

The bottom cutouts 15 and 16 provide the following operational effect when a container is laid on top of another container. That is, when the upper container is unexpectedly lowered onto the lower container in an undesirable direction due to an operational error of a crane as shown in FIG. 4, the bottom edge frames 13 and 14 with the cutouts 17 and 18 of the upper container are free from coming into contact with a fixing twist lock 19 of the lower container thus avoiding being crushed or broken by the lock 19.

If each of the bottom cutouts 15 and 16 is provided with a metal panel 17, 18, each of the bottom edge frames 13 and 14 is effectively protected from the fixing twist lock 19 even when the lock 19 comes into unexpected contact with the frame 13, 14 at the cutout 15, 16.

As described above, the present invention provides a container with an anticontact cutout-structure on the edge frame around each corner casting. The cutout-structure comprises a top cutout and a bottom cutout. The top cutout is formed on each of the top edge frames around each top corner casting of the container. The top cutout almost completely prevents a twist lock from unexpectedly coming into contact with the top edge frames and allows the top edge frames to be free from being crushed or broken by the twist lock when the twist lock engages with the top corner casting of the container.

The bottom cutout is formed on each of the bottom edge frames around each bottom corner casting of the container. The bottom cutout almost completely prevents the bottom edge frame of an upper container from coming into contact with a fixing twist lock of the lower container even when the upper container is unexpectedly lowered onto the lower container in an undesirable direction when the upper container is laid on top of the lower container by a crane. The bottom cutout thus prevents the bottom edge frame from being crushed or broken by the fixing twist lock.

The container's edge frame with such a top or bottom cutout is free from being crushed or broken by a twist lock, thus saving money on maintaining or repairing of the container. The anticontact cutout-structure of this invention thus maintains the appearance of a container for a lengthy period of time and lengthens the expected life span of the container.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A container comprising a plurality of top and bottom edge frames forming a plurality of top and bottom corners, a corner casting provided on each of the corners, and a lock opening formed on each of the top and bottom corner castings and adapted for engaging with a twist lock, further comprising:

a top cutout formed on each of said top edge frames at a position around each of the top corner castings, said top cutout having a length and depth suitable for preventing each of the top edge frames from coming into contact with the twist lock.

2. The container according to claim 1, wherein said top cutout is vertically flat at a side wall approximate to the top corner casting and inclined at the other side wall remote from the top corner casting, and horizontally flat at an intermediate bottom wall.

3. The container according to claim 1, wherein said top cutout is vertically flat at opposite side walls approximate to and remote from the top corner casting and horizontally flat at an intermediate bottom wall.

4. The container according to claim 1, wherein a metal panel is attached to the surface of said top cutout, thus protecting the top cutout from the twist lock.

5. The container according to claim 1, further comprising:

a bottom cutout formed on each of said bottom edge frames at a position around each of the bottom corner castings, said bottom cutout having a length and depth suitable for preventing each of the bottom edge frames from coming into contact with a fixing twist lock.

6. The container according to claim 2, wherein a metal panel is attached to the surface of said top cutout, thus protecting the top cutout from the twist lock.

7. The container according to claim 3, wherein a metal panel is attached to the surface of said top cutout, thus protecting the top cutout from the twist lock.

8. The container according to claim 2, further comprising:

a bottom cutout formed on each of said bottom edge frames at a position around each of the bottom corner castings, said bottom cutout having a length and depth suitable for preventing each of the bottom edge frames from coming into contact with a fixing twist lock.

9. The container according to claim 3, further comprising:

a bottom cutout formed on each of said bottom edge frames at a position around each of the bottom corner castings, said bottom cutout having a length and depth suitable for preventing each of the bottom edge frames from coming into contact with a fixing twist lock.

* * * * *